US009599038B2

(12) United States Patent
Azadeh

(10) Patent No.: US 9,599,038 B2
(45) Date of Patent: Mar. 21, 2017

(54) METHOD AND DEVICE FOR CONTROLLING AN INTERNAL COMBUSTION ENGINE WITH A VARIABLE COMPRESSION RATIO

(71) Applicant: AUDI AG, Ingolstadt (DE)
(72) Inventor: Reza Azadeh, Regensburg (DE)
(73) Assignee: AUDI AG, Ingolstadt (DE)

( * ) Notice: Subject to any disclaimer, the term of this patent is extended or adjusted under 35 U.S.C. 154(b) by 111 days.

(21) Appl. No.: 14/762,356

(22) PCT Filed: Jan. 21, 2014

(86) PCT No.: PCT/EP2014/000146
§ 371 (c)(1),
(2) Date: Jul. 21, 2015

(87) PCT Pub. No.: WO2014/114442
PCT Pub. Date: Jul. 31, 2014

(65) Prior Publication Data
US 2015/0354469 A1 Dec. 10, 2015

(30) Foreign Application Priority Data
Jan. 22, 2013 (DE) ..... 10 2013 001 043

(51) Int. Cl.
*F02B 75/04* (2006.01)
*F02D 15/00* (2006.01)
(Continued)

(52) U.S. Cl.
CPC ..... *F02D 15/00* (2013.01); *F02D 41/04* (2013.01); *F02D 2041/1412* (2013.01);
(Continued)

(58) Field of Classification Search
CPC .. F02D 15/00; F02D 41/04; F02D 2041/1412; F02D 2200/1002; F02D 2200/1004; F02D 2700/03
(Continued)

(56) References Cited

U.S. PATENT DOCUMENTS 4,066,049 A * 1/1978 Teodorescu ..... F01B 3/0002 123/48 B
2006/0180118 A1* 8/2006 Takemura ..... F02B 75/048 123/197.4
(Continued)

FOREIGN PATENT DOCUMENTS

DE 10220598 3/2004
DE 102004031288 1/2006
(Continued)

OTHER PUBLICATIONS

International Search Report issued by the European Patent Office in International Application PCT/EP2014/000146 on Jan. 21, 2014.
Chinese Search Report issued in counterpart Chinese patent application No. 201480005473.9 on Dec. 2, 2016.

*Primary Examiner* — Marguerite McMahon
(74) *Attorney, Agent, or Firm* — Henry M. Feiereisen LLC.

(57) ABSTRACT

In a method for operating an internal combustion engine a compression ratio is set to a setpoint compression ratio by means of an adjustment device, wherein in a normal operating mode of the internal combustion engine the setpoint compression ratio is determined as a function of an, operating variable of the internal combustion engine. The internal combustion engine is at least temporarily operated in a predictive operating mode in which the setpoint compression ratio is determined on the basis of an anticipated estimated operating variable which is estimated on the basis of the instantaneous gradient of the operating variable over time.

10 Claims, 1 Drawing Sheet

Figure 1:
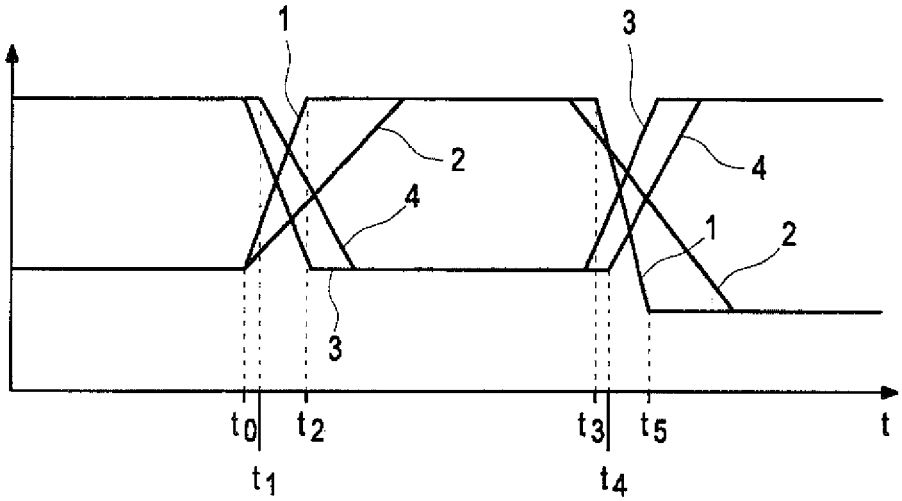

(51) Int. Cl.
*F02D 41/04* (2006.01)
*F02D 41/14* (2006.01)

(52) U.S. Cl.
CPC ..... *F02D 2200/1002* (2013.01); *F02D 2200/1004* (2013.01); *F02D 2700/03* (2013.01)

(58) Field of Classification Search
USPC ..... 123/48 R–48 D, 78 R–78 F
See application file for complete search history.

(56) References Cited

U.S. PATENT DOCUMENTS

| | | | | |
|---|---|---|---|---|
| 2008/0006230 | A1* | 1/2008 | Kadota | F02B 75/044 123/48 R |
| 2013/0055990 | A1* | 3/2013 | Kamada | F02D 15/00 123/48 R |
| 2014/0316683 | A1* | 10/2014 | Whitney | F02D 11/105 701/108 |
| 2015/0039206 | A1* | 2/2015 | Storch | F02D 28/00 701/103 |

FOREIGN PATENT DOCUMENTS

| | | | |
|---|---|---|---|
| DE | 102011017181 | | 10/2012 |
| EP | 1293659 | B1 | 10/2009 |
| JP | 2005-147107 | A | 6/2005 |
| JP | 2010-147107 | | 7/2010 |
| JP | 2010-185416 | A | 8/2010 |

* cited by examiner

METHOD AND DEVICE FOR CONTROLLING AN INTERNAL COMBUSTION ENGINE WITH A VARIABLE COMPRESSION RATIO

CROSS-REFERENCES TO RELATED APPLICATIONS

This application is the U.S. National Stage of International Application No. PCT/EP2014/000146, filed Jan. 21, 2014, which designated the United States and has been published as International Publication No. WO 2014/114442 and which claims the priority of German Patent Application, Serial No. 10 2013 001 043.8, filed Jan. 22, 2013, pursuant to 35 U.S.C. 119(a)-(d).

BACKGROUND OF THE INVENTION

The present invention relates to a method for operating a internal combustion engine, in which a compression ratio is set to a setpoint compression ratio by means of an adjustment device, wherein in a normal operating mode of the internal combustion engine the setpoint compression ratio is determined as a function of an operating variable of the internal combustion engine. The invention further relates to a internal combustion engine.

The internal combustion engine serves for example to drive a motor vehicle. The internal combustion engine has a variable compression ratio, wherein the adjustment device is used to adjust the predetermined setpoint compression ratio at the internal combustion engine. When the setpoint compression ratio changes, the actual compression ratio of the internal combustion engine is adjusted to the setpoint compression ratio by means of the adjustment device. Hereby, however, the adjustment device only achieves a limited actuating speed. The setpoint compression ratio of the internal combustion engine is for example determined so that the fuel consumption is as low as possible. Thereby, however, the knock limit has to be taken into account. At a low load torque at the internal combustion engine, a higher setpoint compression ratio is selected than at a higher load torque. In particular, the setpoint compression ratio is adjusted to a maximum compression ratio of the internal combustion engine during a trailing throttle mode of the internal combustion engine, in which the internal combustion engine is carried along by an external torque, at idling speed and under partial load conditions up to a defined load torque.

When the load torque of the internal combustion engine is increased, for example due to a demand by a driver of the motor vehicle, the existing actual compression ratio has to be minimized as soon as possible in order to provide this load torque without exceeding the knock limit of the fuel. Due to the limited actuating speed, the ignition angle may for example be set during the time required for the actual compression ratio to reach the now lower setpoint compression ratio, so as to observe the knock limit, i.e., so as to avoid knocking of the internal combustion engine. For this purpose, the ignition angle is adjusted to "late". On the other hand, however, when the load torque is decreased, the compression ratio is to be increased as fast as possible to reduce fuel consumption. However, due to the limited actuating speed the adjustment itself can only be realized with a higher fuel consumption.

When the operating point changes or the load torque changes slowly, this is unproblematic because the actuating speed of the adjustment device is sufficient. In the case of dynamic load changes on the other hand, i.e., a rapid change of the operating point or the load torque, the actual compression ratio lags far behind the setpoint compression ratio. In particular, the setpoint compression ratio is only determined from the operating variable of the internal combustion engine after reaching the new operating point and is subsequently set by the adjustment device thus leading to a significant time delay between the actual compression ratio and the optimal compression ratio.

From the state of the art the prior art patent document EP 1293 659 B1 is known. This document describes a control system for a internal combustion engine, which has a compression-ratio-control-device, an acceleration-parameter-attainment-device, an acceleration-determining-device as well as a control device. It is provided that the control device reduces a compression ratio reduction speed by which the motor compression ratio is reduced during motor acceleration, when the motor is in a slow acceleration mode as opposed to a compression ratio reduction speed with which the compression ratio is reduced during motor acceleration when the motor is in a fast acceleration mode. Furthermore, the control device is intended to delay a compression-ratio-reduction-start-time at which the reduction of the motor compression ratio is initiated during motor acceleration when the motor is in a slow acceleration mode, as opposed to a compression-ratio-reduction-start-time at which the reduction of the motor compression ratio is initiated during acceleration when the motor is in a fast acceleration mode.

Furthermore patent document DE 102 20 598 B3 describes a method to adjust the ignition angle to the compression ratio of a internal combustion engine, patent document DE 10 2004 031 288 A1 describes a internal combustion engine with variable compression ratio as well as a method for its operation and patent document DE 10 2011 017 181 A1 a method to operate an adjustment device to variably determine a compression ratio of a internal combustion engine.

SUMMARY OF THE INVENTION

Object of the invention is to propose a method to operate a internal combustion engine, which does not have the aforementioned disadvantage, but enables reducing fuel compensation, in particular also in the case of a rapid change of the operating point or load torque of the internal combustion engine, by rapid adjustment of the compression ratio to an optimal value.

This is achieved according to the invention by a method. in which the internal combustion engine is at least temporarily operated in a predictive operating mode in which the setpoint compression ratio is determined on the basis of an anticipated estimated operating variable, which is estimated on the basis of the actual gradient of the operating variable over time. In contrast to the approach in normal operation mode, which is for example used when the operating variable is constant or merely changes slowly, the setpoint compression ratio is not determined from the actual operating variable but from an expected value for the operating variable, namely the estimated operating variable.

This estimated operating variable is for example estimated on the basis of the actual gradient of the operating variable. The temporal course of the operating variable is thus observed over time and the expected value of the operating variable is calculated from the slope of this course at the actual time point. For this purpose for example the following mathematical relation is used $$M_{t+\Delta t}=dMt/dt\cdot\Delta t,$$

wherein $M_t$ is the operating variable at the actual point of time, dMt/dt is the gradient of the operating variable over time and Δt the time period from the actual time point to a future time point. From these variables the estimated operating variable $M_{t+\Delta t}$ results that is expected for a future time point. Thus, the estimated operating variable is estimated for a time point, at which the determined period of time Δt lies in the future.

On the basis of this estimated operating variable, the setpoint compression ratio is determined analogous to the process for the operating variable in normal operating mode. For this purpose, a mathematical relation, a table or characteristic diagram is for example used, wherein in the normal operating mode the operating variable serves as input variable and in the predictive operating mode the estimated operating variable serves as input variable, while the setpoint compression ratio represents an output variable. The operating variable is for example an actual setpoint operating variable, which is set at the internal combustion engine, or an actual operating variable, which the internal combustion engine currently has. The setpoint operating variable is for example determined from a demanded operating variable, which is itself again determined by a demand of the driver and/or a demand of a driver assistance device of the motor vehicle. The setpoint operating variable is subsequently adjusted at the internal combustion engine so that the actually present operating variable, namely the actual operating variable, changes in the direction of the setpoint operating variable. Thus, while the setpoint operating device is for example directly determined from the demanded operating variable, the actual operating variable lags behind the setpoint operating variable.

With the described process, the setpoint compression ratio is predictively determined during dynamic procedures, i.e., during a rapid load change, which for example results in a rapid change of the actual load torque of the internal combustion engine, so that the adjustment device can already be controlled even though the internal combustion engine has not yet reached the new operating point. During the normal operating mode, however, the setpoint compression ratio is usually only determined from the operating variable, when the internal combustion engine is has reached the new operating point. Consequently, the setpoint compression ratio and correspondingly the present actual compression ratio constantly lag behind the operating variable of the internal combustion engine. This is at least partially prevented by operating the internal combustion engine in the predictive operating mode.

In a further embodiment of the invention, it is provided that the predictive operating mode is initiated when the gradient of an operating element variable over time and/or the gradient of the operating variable over time exceeds a threshold value. Normally, the internal combustion engine is operated in the normal operating mode. However, when one of the mentioned conditions is satisfied, the predictive operating mode is used instead. Thereby, the operating element variable is the value returned by an operating element, wherein the operating element is for example an accelerator pedal of a motor vehicle. It can immediately be recognized that a rapid operation of the operating element by the driver results in a high gradient of the operating element variable. Correspondingly, when the gradient of the operating element variable exceeds the threshold value, it can be determined that the operating variable will change rapidly. The same applies to the gradient of the operating variable, wherein the operating variable for example is a setpoint operating variable, which is in particular determined by a driver assistance device. Advantageously, the predictive operating mode is not only initiated in response to the driver's request, but also when a driver assistance device causes a rapid load change.

An embodiment of the invention provides that the actual load torque of the internal combustion engine is used as operating variable. Correspondingly, the operating variable is an actual operating variable of the internal combustion engine. By using the actual load torque or its gradient, the future required setpoint compression ratio can be accurately determined.

In an embodiment of the invention, it is provided that the estimated operating variable is regularly estimated during performance of the predictive operating mode. Therefore, the estimated operating variable and from this the setpoint compression ratio is not only determined once after initiating the predictive operating mode. Rather, the estimated operating variable and also the setpoint compression ratio are updated periodically during operation in the predictive operating mode. In this way a highest possible accuracy of the estimation of the expected estimated operating variable is achieved. This leads to a rapid setting of the compression ratio to the prospective required compression ratio with which a fuel-efficient operation of the internal combustion engine is achieved.

Due to the periodic estimation of the estimated operating variable and the corresponding determination of the setpoint compression ratio it can be provided to not only use the actual gradient of the operating variable, but also its course. On the basis of this course, an extrapolation of the operating variable can subsequently be accomplished to obtain the expected estimated operating variable.

An embodiment of the invention provides that the derivation of the gradient of the operating variable is determined and the predictive operating mode is terminated when the derivation falls below or exceeds a threshold value. Thus, not only the gradient of the operating variable itself is calculated, but additionally its derivation. In the case of excessive changes of the gradient, which are indicated when the derivation exceeds the threshold, the estimated operating variable cannot be reliably determined on the basis of the gradient of the operating variable. For this reason, the predictive operating mode is terminated and the normal operating mode is performed again. In this way inaccurate predictions of the estimated operating variables and inaccurate setpoint compression ratios based thereon can be prevented, which would otherwise lead to an impairment of the operating behavior of the combustion machine. On the other hand, no estimation is required when the gradient changes slightly, but it is sufficient to determine the setpoint compression ratio in the normal operating mode. This fact is taken into account, in that the predictive operating mode is terminated in case of falling below the threshold value.

Advantageously, the predictive operating mode can be terminated when the gradient of the operating element variable and/or the gradient of the operating variable fall below the threshold value. This condition can be applied in addition to or as an alternative to the aforementioned condition. Also in this case, it is provided to terminate the predictive operating mode and to operate in the normal operating mode again when the condition is satisfied. When falling below the threshold value, this means that the operating variable and with this the setpoint compression ratio will only change slowly. In this case, however, the actuating speed of the adjustment device is sufficient to adjust the compression ratio to the setpoint compression ratio sufficiently fast even in the normal operating mode. Prediction of the estimated operating variable is therefore no longer required.

It is particularly advantageous, when the predictive operating mode is initiated by one of the aforementioned variables when the first threshold value is exceeded and is terminated by falling below a second threshold value. The first threshold value and the second threshold value are advantageously different. The first threshold value is in particular higher than the second threshold value so that a hysteresis-like behavior is achieved. In this way, a fluctuation of the variable that is compared with the threshold value about the threshold value does not result in a constant change between the normal operating mode and the predictive operating mode.

Particularly advantageously the ignition angle is selected to be optimal during the predictive operating mode. As mentioned above, due to the fact that the actual compression ratio lags behind the setpoint compression ratio the ignition angle may have to be changed in case of a rapid load change to stay within the knock limit. Because the predictive determination of the estimated operating variable and with this of the setpoint compression ratio allow achieving the desired compression ratio faster than with known methods, such a less favorable ignition angle can be avoided. Rather, the ignition angle is always selected to be optimal. Alternatively, the ignition angle can be adjusted in this manner, however, to a lesser extent than in methods known in the art.

An advantageous embodiment of the invention provides that the setting of an operating element is used as operating element variable. The setting describes a position of the operating element, which it is caused to assume by a user, for example the driver of the motor vehicle. When the operating element is selected appropriately, an estimated rapid change of the internal combustion engine's operating variable can be concluded.

As operating element, an accelerator pedal, brake pedal or clutch may be used. By actuating one of these operating elements, the driver of the motor vehicle causes non-steady processes, for instance a starting up, accelerating or decelerating.

The invention further relates to an internal combustion engine, in particular for implementing the aforementioned process, with an adjustment device to adjust a compression ratio to a setpoint compression ratio, wherein the internal combustion engine is constructed to determine the setpoint compression ratio as a function of an operating variable of the internal combustion engine. Hereby it is provided that the internal combustion engine is configured to be operated at least temporarily in a predictive operating mode, during which the setpoint compression ratio is determined on the basis of an expected estimated operating variable, which is estimated on the basis of the actual gradient of the operating variable over time. The advantages of such an embodiment of the internal combustion engine or such a method have been mentioned above. The internal combustion engine as well as the corresponding method can be refined according to the aforementioned embodiments so that reference is made thereto.

BRIEF DESCRIPTION OF PREFERRED EMBODIMENTS

Figure 2:
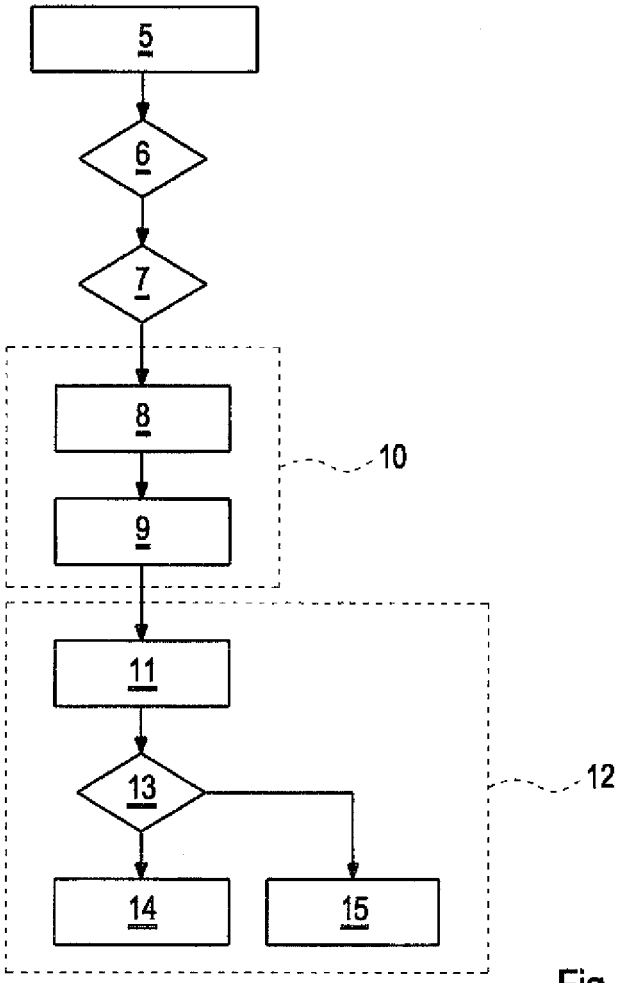

In the following, the invention is described on the basis of the exemplary embodiments shown in the drawing without limiting the invention. It is shown in:

FIG. 1 a diagram in which an operating element variable, a load torque of an internal combustion engine, a setpoint compression ratio as well as an actual compression ratio over time are shown, and FIG. 2 a process diagram of a method to operate a internal combustion engine with a variable compression ratio.

DETAILED DESCRIPTION OF PREFERRED EMBODIMENTS

FIG. 1 shows a diagram in which different variables are plotted over the time t. A course 1 shows the course of an operating element variable, wherein the operating element variable reflects the position of an operating element of a motor vehicle, namely for example an acceleration pedal. It can be seen that a driver of the motor vehicle changes the position of the acceleration pedal at the time point $t_0$ to achieve or compensate a higher load torque of the internal combustion engine of the motor vehicle. The change of the position of the acceleration pedal is completed a the time point $t_2$. Up to the time point $t_3$ the position remains constant. Subsequently the driver again changes the position again up to the time point $t_5$ in order to adjust or compensate a smaller load torque of the internal combustion engine. The course of the load torque is shown by course 2. It can be seen that the load torque lags behind the operating element variable.

The internal combustion engine includes an adjustment device by which the compression ratio can be adjusted in the cylinders of the internal combustion engine. The compression ratio represents the ratio of the cylinder volume prior to a compression to the cylinder volume after a compression. To adjust the compression ratio, a setpoint compression ratio is set at the internal combustion engine or the adjustment device. The course of this setpoint compression ratio is indicated by course 3. It can be seen that the setpoint compression ratio changes during a change of the load torque of the internal combustion engine, which is used as operating variable, based on a maximum value until reaching a minimum value.

However, because the adjustment device is used to adjust the compression ratio, only has a limited actuating speed, the actual compression ratio lags behind the setpoint compression ratio. The course of the actual compression ratio is shown by a course 4. A delay also exists between a first change of the setpoint compression ratio and a first change of the actual compression ratio. While the setpoint compression ratio already changes from the time point $t_0$, this is only the case for the actual compression ratio from the time point $t_1$. This also analogously applies to the reduction of the operating element variable from the time point $t_3$, for which the change of the actual compression ratio only takes place from the time point $t_4$.

The diagram shows that the actual compression ratio follows relatively quickly. This is achieved in that the internal combustion engine can be operated in different operating modes. In a normal operating mode the setpoint compression ratio is to be determined as a function of an operating variable of the internal combustion engine, wherein the load torque can be taken into account as operating variable. In a predictive operating mode on the other hand, the setpoint compression ratio is to be determined as a function of an expected estimated operating variable, wherein this estimated operating variable is estimated on the basis of the actual gradient of the operating variable over time. The setpoint compression ratio is therefore not set to the actual operating point of the internal combustion engine, but to a prospective expected operating point. In this way, the actual compression ratio can be adjusted to an optimal compression ratio considerably faster than in normal operating mode, which ensures a fuel-efficient operation of the internal combustion engine.

FIG. 2 shows a process diagram that illustrates the process for the predictive operating mode. The process starts at a starting point 5. In a step 6 it is examined whether the gradient of an operating element variable, in the described embodiment the adjustment of the acceleration pedal, is different from zero. When this is the case, it is examined in a step 7, whether the gradient is higher than a threshold value. Thereby, an absolute value is used for the gradient so that when the setting is changed toward a decrease of the load torque and when the setting is changed toward an increase of the load torque a change from the normal operating mode to the predictive operating mode is made.

When the condition is actually satisfied, i.e., when the gradient is higher than the threshold, the gradient of the operating variable, for example the gradient of the actual load torque of the internal combustion engine, is determined in a step 8. From this gradient, the estimated operating variable is determined in step 9 and from the estimated operating variable the setpoint compression ratio. The setpoint compression ratio is determined for a time point that lies within a determined period of time in the future. The operations 8 and 9 are therefore performed at a time point t, which is indicated by box 10.

Subsequently, in an operation 11, the derivation of the gradient of the operating variable is determined, in particular the second derivative of the load torque of the internal combustion engine. To accomplish this calculation, at least two values for the gradient of the operating variable are necessary. For instance, the operation 11, as indicated by bezel 12, is performed at a time point t following the time point $t+\Delta t$. After operation 11, it is examined in an operation 12 whether the derivation is lower than a threshold value. When this is the case, the predictive operating mode is terminated in an operation 14 and the normal operating mode is performed again because a prediction is not necessary when the derivation has a small value. If, however, the derivation of the gradient of the operating variable is higher than the threshold value, the estimated operating variable and with this the setpoint compression ratio is updated with the now actual gradient of the operating variable at the point of time $t+\Delta t$ in operation 15.

The setpoint compression ratio is determined in the predictive operating mode analogous to the procedure in the normal operating, mode, wherein instead of the operating variable, the estimated operating variable is taken into account as a basis. The determination can for example be performed by means of a mathematical relation, a table or a characteristic diagram, wherein the operating variable is used as input variable in the normal operating mode and the estimated operating variable in the predictive operating mode. Subsequently, the setpoint compression mode is used as output variable. With such a procedure, a rapid adjustment of the actual compression ratio to the setpoint operating ratio can be achieved in the predictive operating mode. Thereby, an otherwise necessary adaptation of the ignition angle during the adjustment of the compression ratio by the adjustment device can be mostly or even completely avoided, so that in overall fuel consumption and pollutant emissions are significantly reduced.

What is claimed is:

1. A method of operating an internal combustion engine, comprising:

with an adjustment device setting a compression ratio to a setpoint compression ratio, wherein in a normal operating mode of the internal combustion engine the setpoint compression ratio is determined as a function of an operating variable of the internal combustion engine; and operating the internal combustion engine at least temporarily in a predictive operating mode, in which the setpoint compression ratio is determined as a function of an expected estimated operating variable, said expected estimated operating variable being estimated as a function of an actual gradient of the operating variable of the internal combustion engine over time.

2. The method of claim 1, wherein the predictive operating mode is initiated when a gradient of an operating element variable over time and/or the gradient of the operating variable over time exceeds a threshold value.

3. The method, of claim 1, wherein an actual load torque of the internal combustion engine is used as the operating variable.

4. The method of claim 1, wherein the estimated operating variable is estimated regularly during performance of the predictive operating mode.

5. The method of claim 1, further comprising determining a derivative of the gradient of the operating variable and terminating the predictive operating mode when the derivative falls below or exceeds a threshold value.

6. The method of claim 2, further comprising terminating the predictive operating mode when the gradient of the operating element variable and/or the gradient of the operating variable fall below the threshold value.

7. The method of claim 1, wherein an optimal ignition angle is selected in the predictive operating mode.

8. The method of claim 2, wherein a setting of the operating element is used as operating element variable.

9. The method of claim 2, wherein an acceleration pedal, a brake pedal or a clutch is used as the operating element.

10. An Internal combustion engine comprising:

an adjustment device to adjust a compression ratio to a setpoint compression ratio, wherein the internal combustion engine is configured to determine in a normal operating mode the setpoint compression ratio as a function of an operating variable of the internal combustion engine, and wherein the internal combustion engine is configured to be operated at least temporarily in a predictive operating mode in which the setpoint compression ratio is determined as a function of an expected estimated setpoint operating variable, which is estimated as a function of an actual gradient of the operating variable over time.

* * * * *